US008702272B2

(12) United States Patent
Chuang

(10) Patent No.: US 8,702,272 B2
(45) Date of Patent: Apr. 22, 2014

(54) LED LIGHT BULB

(75) Inventor: Jui-Chien Chuang, New Taipei (TW)

(73) Assignee: Fleda Technology Corporation, New Taipei (TW)

( * ) Notice: Subject to any disclaimer, the term of this patent is extended or adjusted under 35 U.S.C. 154(b) by 262 days.

(21) Appl. No.: 13/354,144

(22) Filed: Jan. 19, 2012

(65) Prior Publication Data

US 2013/0188360 A1 Jul. 25, 2013

(51) Int. Cl.
*F21S 4/00* (2006.01)
*F21V 21/00* (2006.01)

(52) U.S. Cl.
USPC ..... 362/249.02; 362/294; 362/311.02; 362/800

(58) Field of Classification Search
USPC ..... 362/249.02, 294, 311.02, 800
See application file for complete search history.

(56) References Cited

U.S. PATENT DOCUMENTS 7,575,346 B1 * 8/2009 Horng et al. ..... 362/373

* cited by examiner

*Primary Examiner* — Jason Moon Han
(74) *Attorney, Agent, or Firm* — Muncy, Geissler, Olds & Lowe, P.C.

(57) ABSTRACT

A LED light bulb includes a light bulb adapter; a housing fixed on the light bulb adapter and having an accommodating space, wherein the housing has at least a vent hole; a convective heat dissipation piece including a first heat dissipation part and a second heat dissipation part connected under the first heat dissipation part; a light-emitting module disposed on a top surface of the convective heat dissipation piece; and a light bulb cover disposed on the top surface of the convective heat dissipation piece and covering the light-emitting module.

8 Claims, 4 Drawing Sheets

LED LIGHT BULB

BACKGROUND OF THE INVENTION

1. Field of the Invention

The present invention relates to an illuminating device, and more particularly to a LED light bulb.

2. Description of the Prior Art

Light-emitting diodes (LED) have the properties of long life expectancy, low power consumption and good durability; therefore, LED illuminating devices have become the mainstream of green energy and environmental friendly developments. In the future, the LED light bulbs will replace the traditional incandescent light bulbs or energy-efficient light bulbs. Because the LED light bulbs generally adopt high power LED chips, large amount of heat would be generated. The heat dissipation problem could shorten the life of the LED light bulbs. Thus, in order to enhance the heat dissipation effect, additional heat dissipation components are usually introduced to the design, such as heat dissipation fins. However, such design often has the issue of insufficient heat dissipation or overly complicated design which increases the manufacturing complexity and cost. Hence, it is an important topic of the field that the heat dissipation problem of the LED light bulb be addressed.

SUMMARY OF THE INVENTION

One object of the present invention is to provide a LED light bulb using an excellent convective heat dissipation structure formed by the assembly of a convective heat dissipation piece and a housing to solve the heat dissipation problem of the LED light bulb and enhance the heat dissipation rate.

According to an embodiment, the LED light bulb includes a light bulb adapter; a housing fixed on the light bulb adapter and having an accommodating space, wherein the housing has at least a vent hole; a convective heat dissipation piece including a first heat dissipation part and a second heat dissipation part connected under the first heat dissipation part; a light-emitting module disposed on a top surface of the convective heat dissipation piece; and a light bulb cover disposed on the top surface of the convective heat dissipation piece and covering the light-emitting module. The second heat dissipation part is located in the accommodating space; an outer border of the first heat dissipation part is exposed to the outside and a lower border of the first heat dissipation part has a first gap with respect to the upper border of the housing; the second heat dissipation part has a second gap with respect to an internal wall of the housing; the first gap, the second gap and the vent hole of the housing are connected; a plurality of first through-holes extend from a top surface to a bottom surface of the first heat dissipation part and connect with the first gap; a second through-hole extends from the top surface of the first heat dissipation part to a bottom surface of the second heat dissipation part and connects with the second gap; and the light-emitting module has a third through-hole connected with the second through-hole.

The foregoing aspects and the accompanying advantages of this invention will become more readily appreciated from the following detailed description taken in conjunction with the attached drawings.

DETAILED DESCRIPTION OF THE INVENTION

The examples described herein are provided merely for purposes of illustration and are not intended to limit the present invention.

Figure 1:
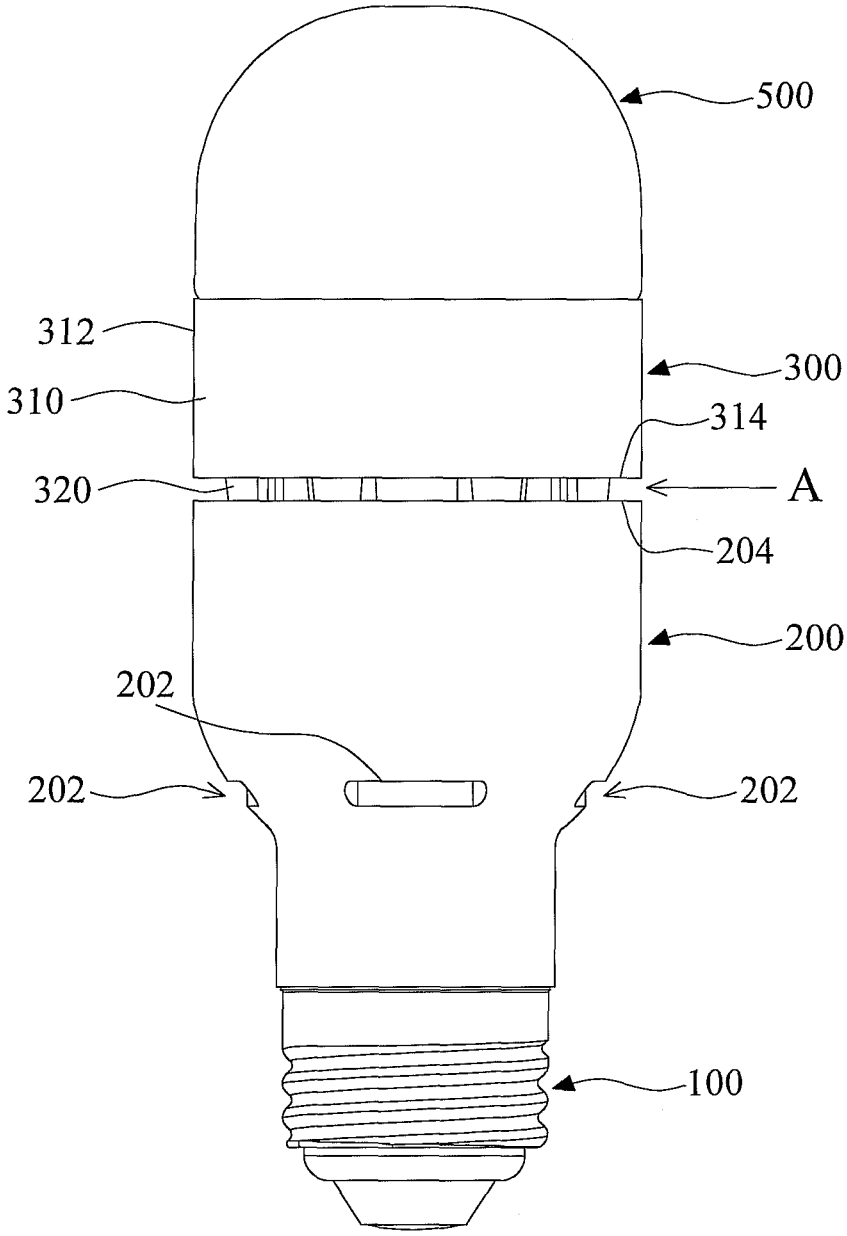
FIG. 1 is a schematic diagram of an embodiment the present invention.

Referring to FIG. 1, there is schematically illustrated an external structure of a LED light bulb according to an embodiment. As illustrated in FIG. 1, in the present embodiment, the LED light bulb includes a light bulb adapter 100, a housing 200, a convective heat dissipation piece 300, a light-emitting module 400 (not illustrated in FIG. 1 and reference can be made to FIG. 2A) and a light bulb cover 500. The housing 200 is fixed on the light bulb adapter 100 and an internal portion of the housing 200 has an accommodating space. The housing 200 has at least one vent hole 202. In the present embodiment, there exist a plurality of vent holes. Nevertheless, one skilled in the art should understand that the quantity of the vent holes 202 is determined by the shape and spatial configuration of the vent hole, so one vent hole may also suffice for the function.

Continuing the above description, the convective heat dissipation piece 300 in the present embodiment includes a first heat dissipation part 310 and a second heat dissipation part 320. The second heat dissipation part 320 is located under the first heat dissipation part 310. Most of the second heat dissipation part 320 is located within the accommodating space of the housing 200. An outer border 312 of the first heat dissipation part 310 is exposed to the outside and a lower border 314 of the first heat dissipation part 310 has a first gap A with respect to the upper border 204 of the housing 200. The second heat dissipation part 320 is exposed at the inner portion of the first gap A. The light-emitting module 400 (as illustrated in FIG. 1A) is disposed on a top surface of the convective heat dissipation piece 300 and the light bulb cover 500 disposed on the top surface of the convective heat dissipation piece 300 covers the light-emitting module 400 (as illustrated in FIG. 1A).

Figure 2A:
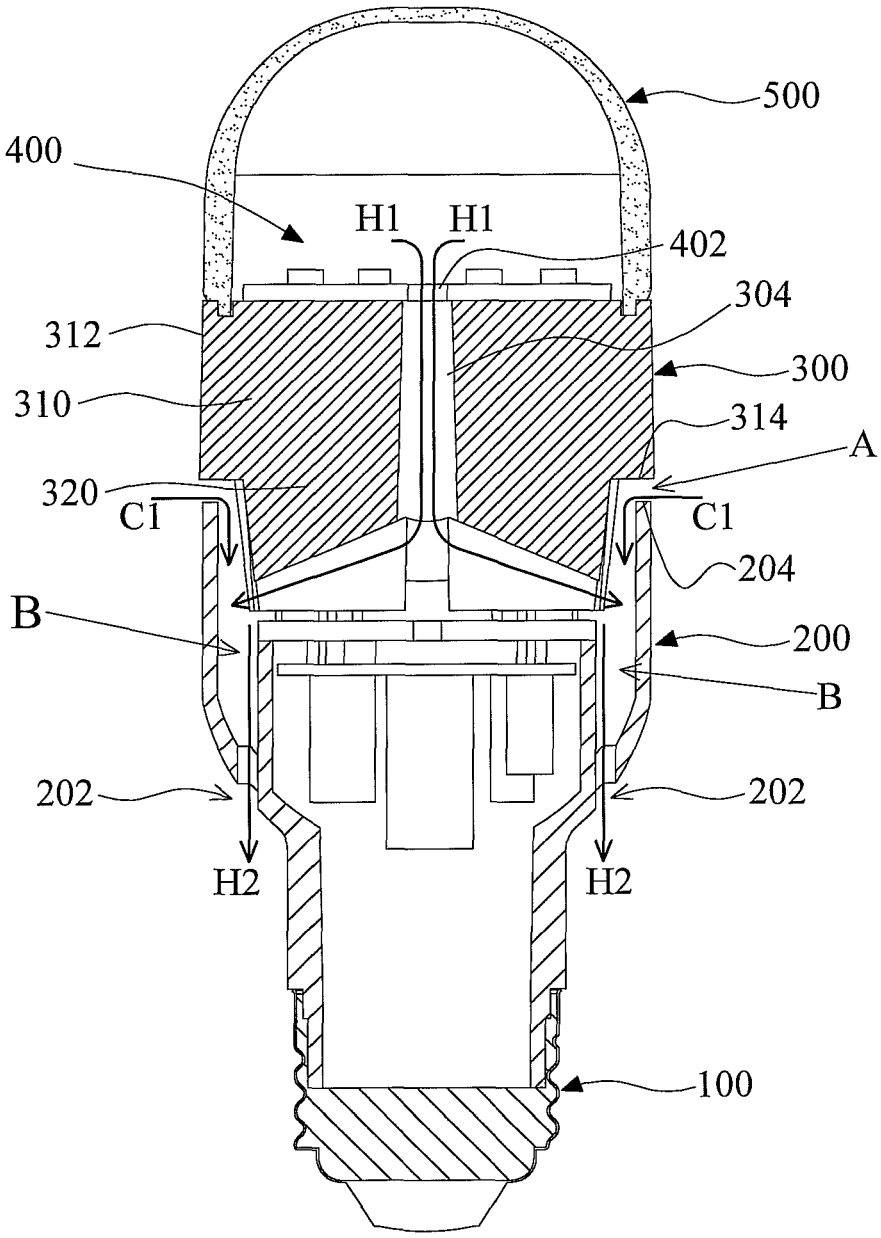
FIG. 2A and FIG. 2B are schematic diagrams of an embodiment of the present invention.
Figure 2B:
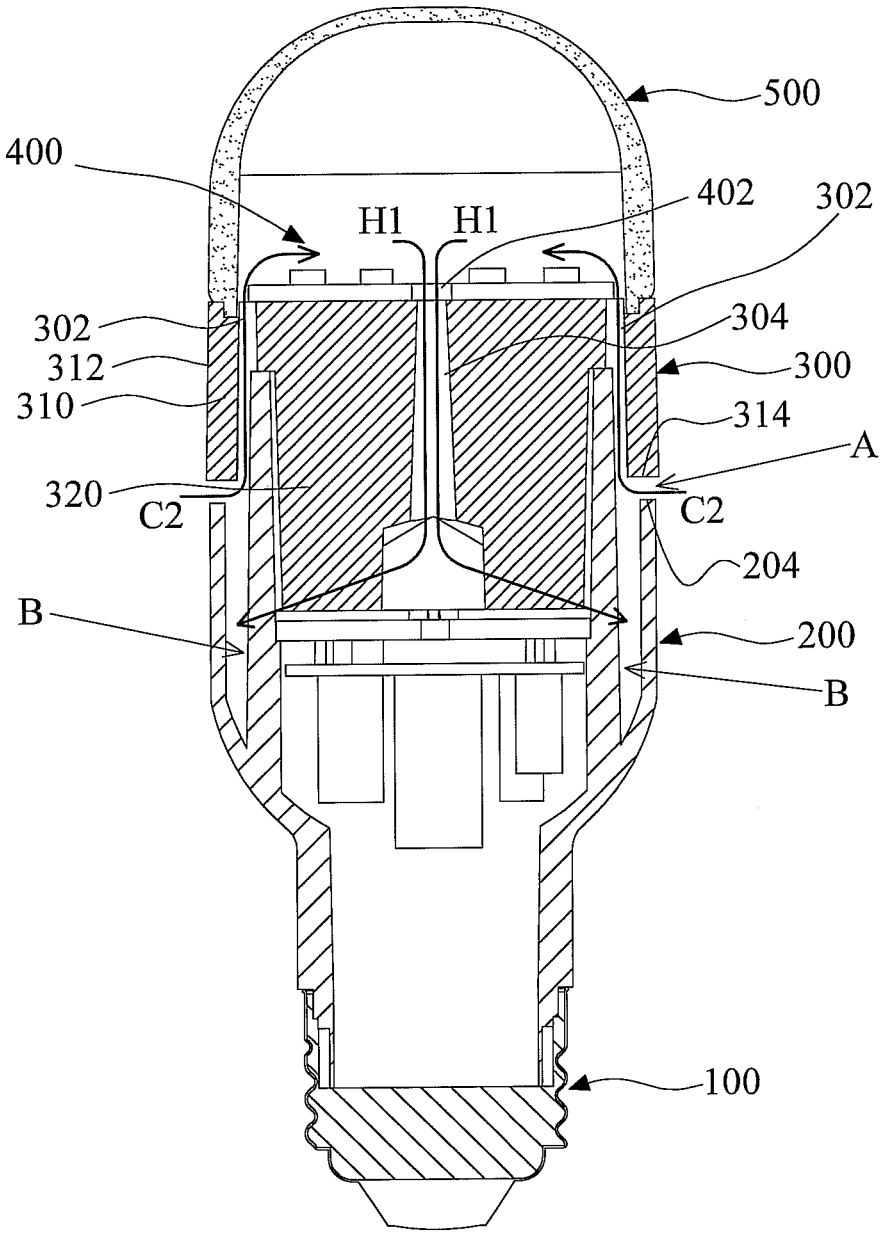

Referring to FIG. 2A and FIG. 2B, there are schematically illustrated sectional views of the LED bulbs from different angles. As illustrated in FIG. 2A and FIG. 2B, the second heat dissipation part 320 is located in the accommodating space of the housing 200. The first gap A exists between the lower border 314 of the first heat dissipation part 310 and the upper border 204 of the housing 200. In the housing 200, a second gap B exists between the second heat dissipation part 320 and the internal wall of the housing 200. The first gap A, the second gap B and the vent hole 200 of the housing 200 are connected.

Moreover, as illustrated in FIG. 2B, there exist a plurality of first through-holes 320 extend from a top surface to a bottom surface of the first heat dissipation part 310 and connect with the first gap A, and a second through-hole 304 extend from the top surface of the first heat dissipation part 310 to a bottom surface of the second heat dissipation part 320 and connects with the second gap B. The light-emitting module 400 has a third through-hole 402 connects with the second through-hole 304.

By configuring the convective heat dissipation piece 300 and the housing 200 together, an excellent convective heat dissipation structure is formed. The light-emitting module 400 disposed on top of the convective heat dissipation piece 300 not only could dissipate heat directly through conduction, but can also dissipate heat through convection with outstanding effect provided by the present invention. According to the present invention, cold air from the external environment can be directed in from the first gap A around the periphery of the LED light bulb. The entering air flow path of the cold air can be divided into paths indicated by the arrows C1 and C2. The cold air flow path C2 starts from the first gap A, runs through the first through-hole 302 and enters into the light bulb cover 500 where the light-emitting module 400 is located. The hot air generated by the light-emitting module 400 flows along the hot air flow path H1 to the second through-hole 304 connecting with the second gap B and along the H2 direction to reach the vent hole 202 where it is directed out.

To describe further in detail, the cold air along the cold air flow path C1 moves toward the direction of the second gap B and therefore the hot air moving along the air flow path H2 can be more effectively carried out from the vent hole 202 by the convection current. It is clear that the convective heat dissipation structure of the present invention creates a natural circulation for the cold and hot air, and does not have to rely on an external force such as a fan to dissipate heat through convection. The entering cold air drives the hot air to naturally flow along the convective heat dissipation structure of the present invention to a predetermined position to be vented out, and the hot air is continuously carried out by circulation and would not remain inside the light bulb.

Figures 3A, 3B:
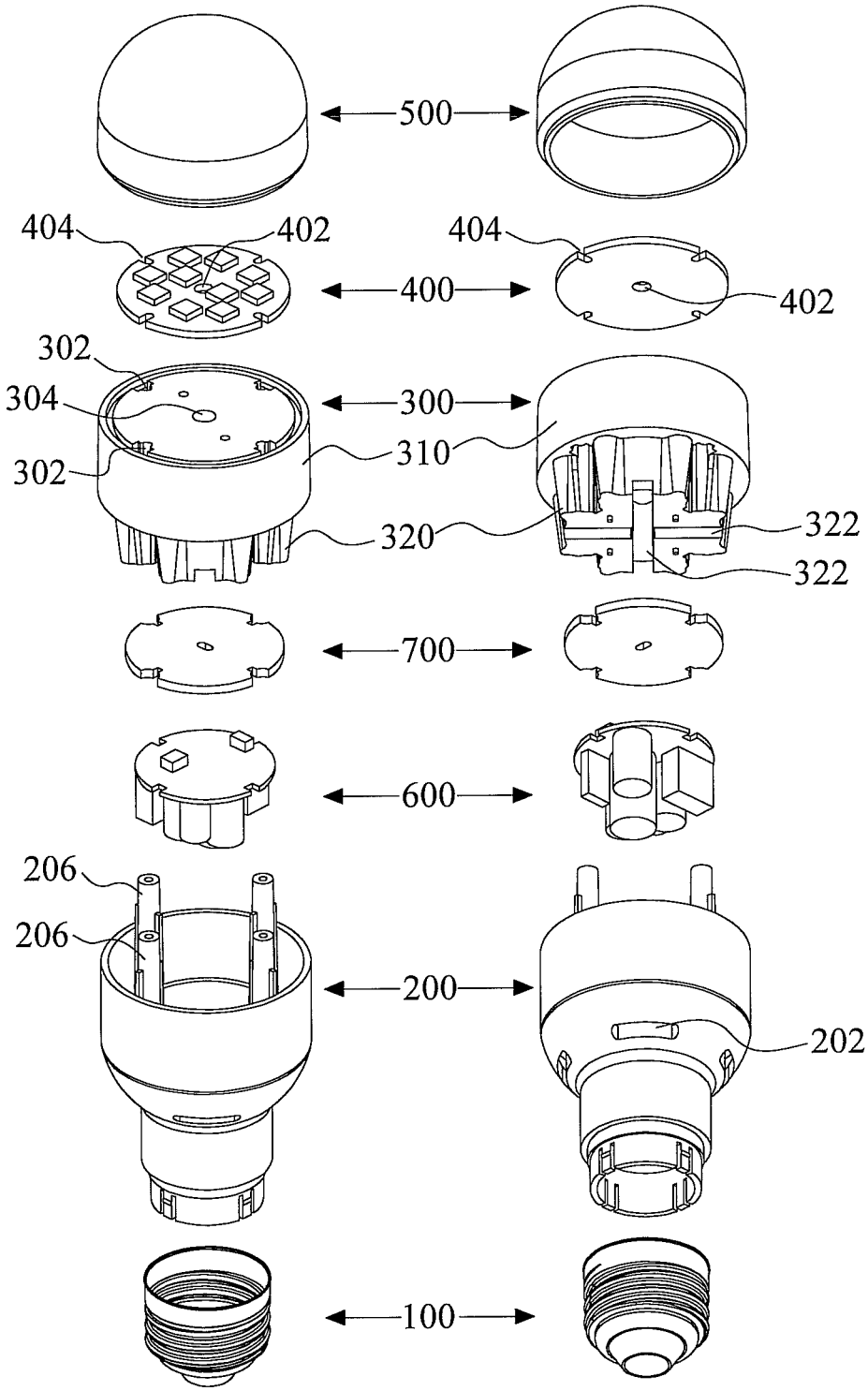
FIG. 3A and FIG. 3B are schematic diagrams illustrating exploded views of an embodiment of the present invention from different angles.

Referring to FIG. 3A and FIG. 3B, there are schematically illustrated exploded views of the LED light bulb according to an embodiment from different angles. As illustrated in FIG. 3A and FIG. 3B, the first through-holes 302 are disposed on the peripheral region of the first heat dissipation part 310 and surround the light-emitting module 400. According to the present embodiment, there are recesses 404 on the border of the light-emitting module 400 corresponding to the first through-holes 302 so that the light-emitting module 400 would not block the first through-holes 302. It should be understood by one skilled in the art that as long as the light-emitting module 400 is designed such that it does not block the first through-hole 302, it may not be necessary the corresponding recesses 404 on the light-emitting module 404 exist, and the description therefor is omitted to avoid imposing unnecessary limitations.

Continuing the above description, the present invention may configure a power conversion module 600 according to the power design requirement of the LED light bulb. The power conversion module 600 can be disposed in the accommodating space of the housing 200 and under the second heat dissipation part 320. A division plate 700 can be configured between the power conversion module 600 and the second heat dissipation part 320 according to the assembling design requirement. Of course, if the division plate 700 is configured on the convection path of the hot and cold air, corresponding openings or recesses would need to be disposed on the division plate 700 to accommodate to the overall convective heat dissipation structure. Besides, the hot air generated by the power conversion module 600 would also be carried away during the course of cold air entering along the path C1 and hot air exiting along the path H2.

According to the present invention, hot air generated by the light-emitting module 400 would be directed through the second through-hole 304 and dissipated out from the vent hole 202 of the housing 200, i.e., the hot air flow path starts from the air flow path H1 and continues to the air flow path H2. Additionally, there may be an air flow guiding part disposed on the bottom surface of the second heat dissipation part for guiding the air flow from the second through-hole 304 to the region of the second gap B. The air flow guiding part may be an inclined groove 322, as illustrated in FIG. 3B. The air flow guiding part can help air flow from the second through-hole 304 be guided to the region of the second gap B and vented out from the vent hole 202 of the housing 200. The object of the air flow guiding part is to facilitate air flow movement and whether it is in the form of channel, groove, or through-hole is determined according to design requirements, and its particular form disclosed should not limit the present invention.

According to the present invention, the light bulb cover 500 can be an ordinary light bulb cover or a light bulb cover equipped with a condensing lens, and the light bulb cover may have an arc convex surface. The key point of the present invention lies in the excellent heat dissipation structure formed by the assembly of the convective heat dissipation piece 300 and the housing 200. One having ordinary skilled in the art should be able to apply a variety of ways to assemble other parts of the present invention. For example, according to an embodiment, the light bulb cover 500 and the first heat dissipation part 301 are joined by an engaging structure. Referring to FIG. 2A and FIG. 2B, a protruding part (not illustrated in the figure) can be disposed on the lower border or the light bulb cover 500 to engage with an indenting part on the top surface of the first heat dissipation part 310. Also, there can be a plurality of engaging columns 206 disposed in the internal portion of the housing 200 to lock with the convective heat dissipation piece 300. Of course, corresponding structure would be disposed on the convective heat dissipation piece 300 to lock with the plurality of the engaging columns 206.

According to the foregoing description, the present invention is characterized in the structure formed by the assembly of the convective heat dissipation piece and housing, and its use for convective heat dissipation. The feature of the convection structure lies in the natural cold and hot air circulation formed. Cold air from the outside follows the air flow path C2 to enter from the first gap A, flow through the first through-hole of the first heat dissipation part and arrive at the inside of the light bulb cover; hot air of the light-emitting module inside the light bulb cover follows the air flow path H1 to flow through the second through-hole of the first heat dissipation and be directed out from the bottom of the second heat dissipation part, and then the hot air follows the air flow path H2 to be dissipated out from the vent hole of the housing. The structural design of the present invention guides the natural circulation of the cold and hot air, thereby achieving the convective heat dissipation effect. Cold air from the outside also follows the air flow path C 1 to be directed in along the direction from the first gap A towards the second gap B. In this way, hot air directed out from the bottom of the heat dissipation part can be dissipated out with the cold air from the air flow path C1 along the air flow path H2.

The present invention emphasizes on the air flow channel formed by the through-holes and gaps and therefore does not require the structures of the first heat dissipation part and the second heat dissipation part to be specifically limited. In brief, the first heat dissipation part must have through-holes and the second heat dissipation part must maintain a gap with respect to the internal wall of the housing. Hence, the size of the second heat dissipation part should be smaller than the housing. Although it is illustrated in the figure that the second heat dissipation part has a flower shape and a fin structure, one skilled in the art should understand that the present invention should not be thus limited.

To summarize the foregoing description, the LED light bulb of the present invention uses the excellent convective heat dissipation structure formed by the assembly of the convective heat dissipation piece and the housing to effectively solve the heat dissipation problem of the LED light bulb and enhance the heat dissipation rate.

While the invention has been described with respect to particular embodiments and specific examples thereof, it should be understood that other embodiments may fall within the spirit and scope of the invention. The scope of the invention should, therefore, be determined from the appended claims along with their full scope of equivalents.

What is claimed is:

1. A light-emitting diode (LED) light bulb, comprising:

a light bulb adapter;

a housing fixed on the light bulb adapter and having an accommodating space, wherein the housing has at least a vent hole;

a convective heat dissipation piece comprising a first heat dissipation part and a second heat dissipation part connected under the first heat dissipation part, wherein the second heat dissipation part is located in the accommodating space;

an outer border of the first heat dissipation part is exposed to the outside and a lower border of the first heat dissipation part has a first gap with respect to the upper border of the housing;

the second heat dissipation part has a second gap with respect to an internal wall of the housing;

the first gap, the second gap and the vent hole of the housing are connected;

a plurality of first through-holes extend from a top surface to a bottom surface of the first heat dissipation part and connect with the first gap; and a second through-hole extends from the top surface of the first heat dissipation part to a bottom surface of the second heat dissipation part and connects with the second gap;

a light-emitting module disposed on a top surface of the convective heat dissipation piece and having a third through-hole connected with the second through-hole; and a light bulb cover disposed on the top surface of the convective heat dissipation piece and covering the light-emitting module.

2. The LED light bulb according to claim 1, further comprising a power conversion module disposed in the accommodating space and under the second heat dissipation part.

3. The LED light bulb according to claim 1, wherein the plurality of first through-holes are disposed on the top surface of the first heat dissipation part and surrounds the light emitting module, and air coming from the first gap would enter from the plurality of first through-holes into the light bulb cover.

4. The LED light bulb according to claim 3, wherein hot air generated by the light-emitting module would be directed through the second through-hole and dissipated out from the vent hole of the housing.

5. The LED light bulb according to claim 1, wherein the bottom surface of the second heat dissipation part has an air flow guiding part for guiding the air flow from the second through-hole to the region of the second gap and dissipated out from the vent hole.

6. The LED light bulb according to claim 1, wherein the light bulb cover has a condensing lens and has an arc convex surface.

7. The LED light bulb according to claim 1, wherein the light bulb cover and the first heat dissipation part are joined by an engaging structure.

8. The LED light bulb according to claim 1, wherein the internal portion of the housing has a plurality of engaging columns for locking with the convective heat dissipation piece.

* * * * *